United States Patent [19]

Scarnera

[11] Patent Number: 4,964,377

[45] Date of Patent: Oct. 23, 1990

[54] IGNITION SYSTEM FOR AN INTERNAL COMBUSTION ENGINE

[75] Inventor: Michele Scarnera, Torino, Italy

[73] Assignee: Marelli Autronica S.p.A., Milano, Italy

[21] Appl. No.: 440,188

[22] Filed: Nov. 22, 1989

[30] Foreign Application Priority Data

Nov. 22, 1988 [IT] Italy ..... 68040 A/88

[51] Int. Cl.[5] ..... F02P 3/06

[52] U.S. Cl. ..... 123/605; 123/602; 123/604

[58] Field of Search ..... 123/594, 596, 601, 602, 123/604, 605, 606, 637; 315/209 CD; 363/21

[56] References Cited

U.S. PATENT DOCUMENTS

| | | | |
|---|---|---|---|
| 3,381,172 | 4/1968 | Weiner | 123/605 |
| 3,504,658 | 4/1970 | Chavis | 123/605 |
| 4,228,780 | 10/1980 | Kiess | 123/596 |
| 4,479,467 | 10/1984 | Burrows et al. | 123/606 |
| 4,480,624 | 11/1984 | Anderson | 123/602 |
| 4,596,226 | 6/1986 | Kondo et al. | 123/605 |
| 4,868,730 | 9/1989 | Ward | 36/321 |
| 4,886,036 | 12/1989 | Johanssen et al. | 123/596 |

*Primary Examiner*—Raymond A. Neill

*Attorney, Agent, or Firm*—Sughrue, Mion, Zinn, Macpeak & Seas

[57] ABSTRACT

In a first operative mode, the control unit first causes energy to be stored by the inductor and then connects the inductor to the capacitor so as to form a resonance circuit whose energy is discharged into the primary winding of the coil in order to generate a spark. In a second operative mode, the unit causes a plurality of cycles to be effected to charge the capacitor so as to increase the voltage across its terminals at each cycle and the capacitor is then discharged into the primary winding of the ignition coil in order to generate the spark.

4 Claims, 3 Drawing Sheets

IGNITION SYSTEM FOR AN INTERNAL COMBUSTION ENGINE

Figure 1:
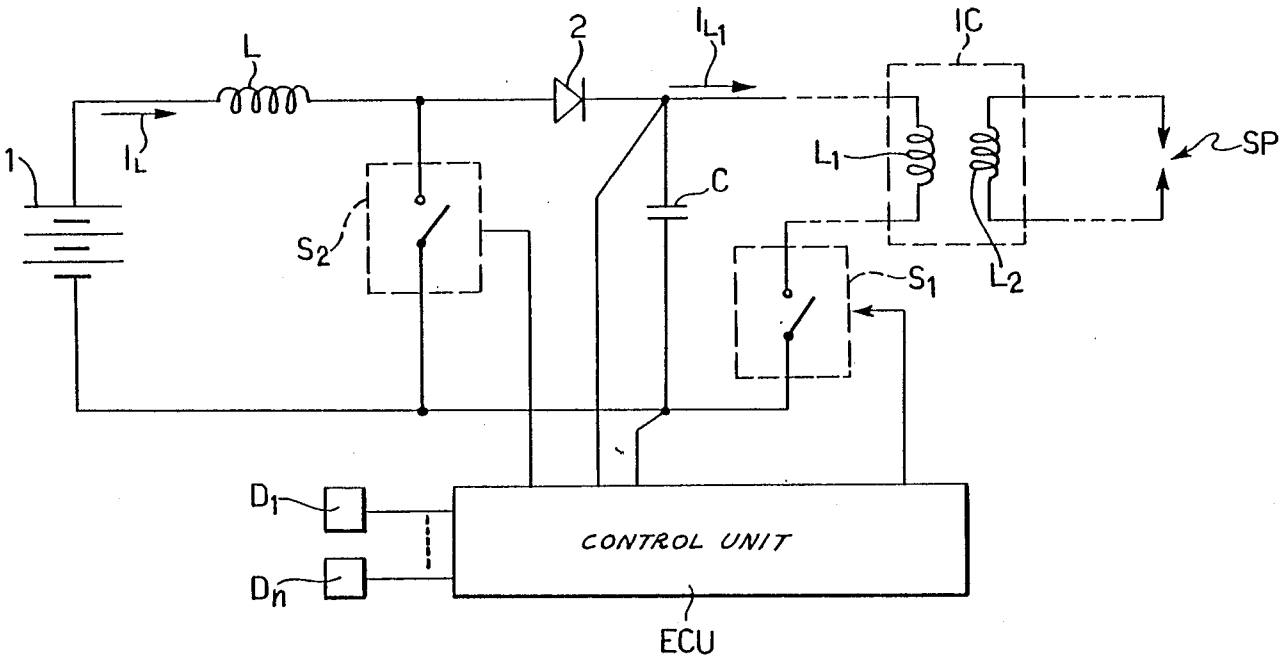

The present invention relates to an ignition system for an internal combustion engine, particularly for a high-performance engine, for example, an engine for racing vehicles.

More particularly, the invention relates to an ignition system including

- a low-voltage direct-current supply,
- at least one spark plug,
- an ignition coil with a primary winding for connection to the supply and a secondary winding for connection to the at least one plug,
- at least one electronic switch between the primary winding of the coil and the supply for controlling the current flow in the primary winding,
- sensor means for providing electrical signals indicative of operating conditions of the engine, and
- an electronic control and operating unit arranged to control the at least one electronic switch in a predetermined manner in dependence on the signals provided by the sensor means.

Ignition systems of this type produced hitherto divide basically into two categories: so-called inductive-discharge systems and capacitive-discharge systems.

In inductive-discharge ignition systems, in order to generate a spark, an electronic switch is closed so as to allow current to flow in an inductor constituted, for example, by the primary winding of the ignition coil. As soon as the current in the inductor reaches a predetermined minimum level, the electronic switch is opened and causes a spark to be generated in the plug connected to the secondary winding of the ignition coil.

Inductive-discharge ignition systems have very simple circuitry and are widely used in motor cars and in commercial vehicles.

A limitation on the use of inductive-discharge ignition systems lies in the time needed for the current in the inductor to reach the minimum level which enables the subsequent triggering of the spark. When the rate of rotation of the engine is high, the time available for current to flow in the inductor is very short and is not always sufficient for the minimum level needed for sparking to be reached. In practice, this disadvantage precludes the use of inductive-discharge ignition systems in high-performance engines, for example in racing cars, which are expected to reach very high rates of rotation in use.

In order to reduce the time needed to achieve an adequate current in the inductor it would be necessary to use a very large coil, characterized by very low losses which would be unacceptable in many applications both from a technical point of view and from an economic point of view.

Capacitive-discharge ignition systems generally provide for the use of a capacitor which is charged to a voltage much higher than that of the supply, for example up to 400–600 V, by means of a positive booster device. The capacitor is then discharged into the primary winding of the ignition coil by means of an electronic switch in order to generate the spark in the plug or plugs concerned at the time. The positive booster devices used typically comprise switching circuits formed with the use of transistors and transformers.

Capacitive-discharge systems generally enable the energy needed to trigger the spark to be stored very quickly. Such systems have the disadvantage however, of being more complex and expensive; moreover, their energy yields are quite low.

The object of the present invention is to provide an ignition system for an internal combustion engine of the type indicated above, which, essentially, has the positive characteristics of both inductive and capacitive ignition systems whilst overcoming their disadvantages.

According to the invention, this object is achieved by means of an ignition system of the type specified above, the main characteristic of which lies in the fact that it also includes

- an inductor between the supply and the primary winding of the ignition coil,
- a capacitor in parallel with the circuit branch including the primary winding and the first electronic switch,
- a second electronic switch between the inductor and the supply and adapted, in the closed condition, to disconnect the supply from the circuit downstream of the inductor; and
- in that, in order to produce a spark in the at least one plug, the control and operating unit is arranged to pilot the first and second switches in either a first or a second operative mode in dependence on the signals provided by the sensor means;
- the unit causing, in the first operative mode,
  - the closure of the second switch and the connection of the inductor to the supply in order to store energy in the inductor, and then
  - the opening of the second switch and the closure of the first in order to connect the inductor to the capacitor so as to form a resonance circuit whose energy is discharged into the primary winding of the coil;
- and in the second operative mode the unit causing
  - a plurality of cycles to be effected to charge the capacitor, in each of which the second switch is closed in order to store energy in the inductor and then opened in order to transfer the energy to the capacitor so that, in each cycle, the voltage across the capacitor is raised until it reaches a predetermined value, and then
  - the closure of the first switch and the discharge of the capacitor into the primary winding of the ignition coil.

Figure 2:
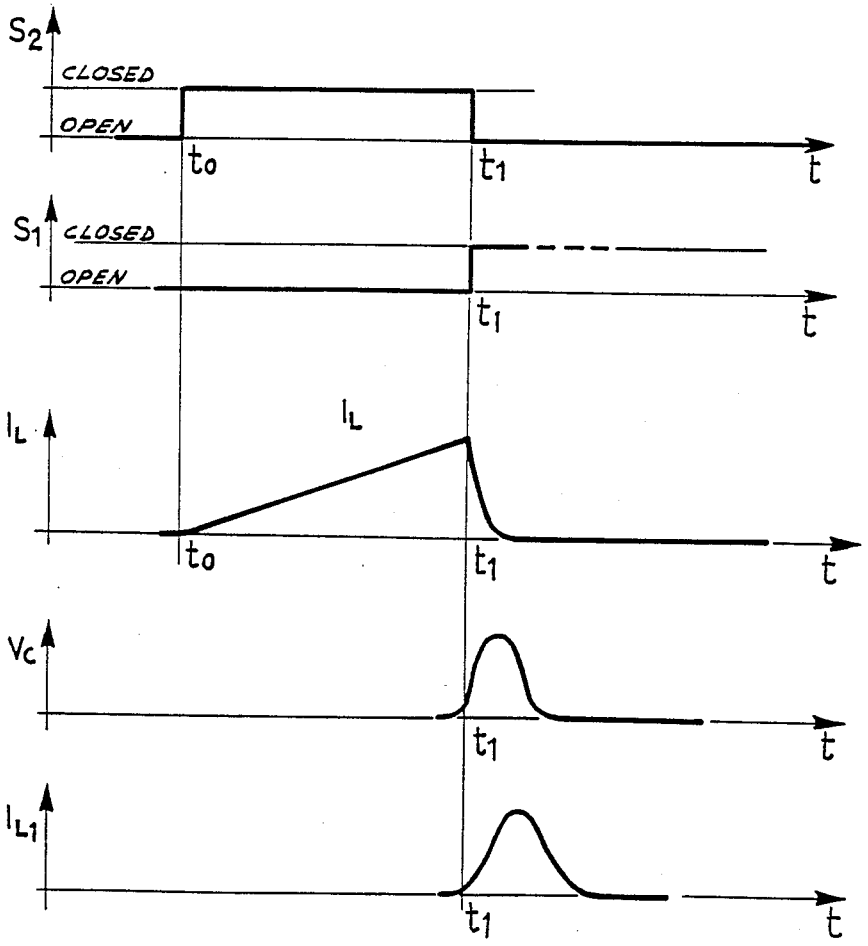
Figure 3:
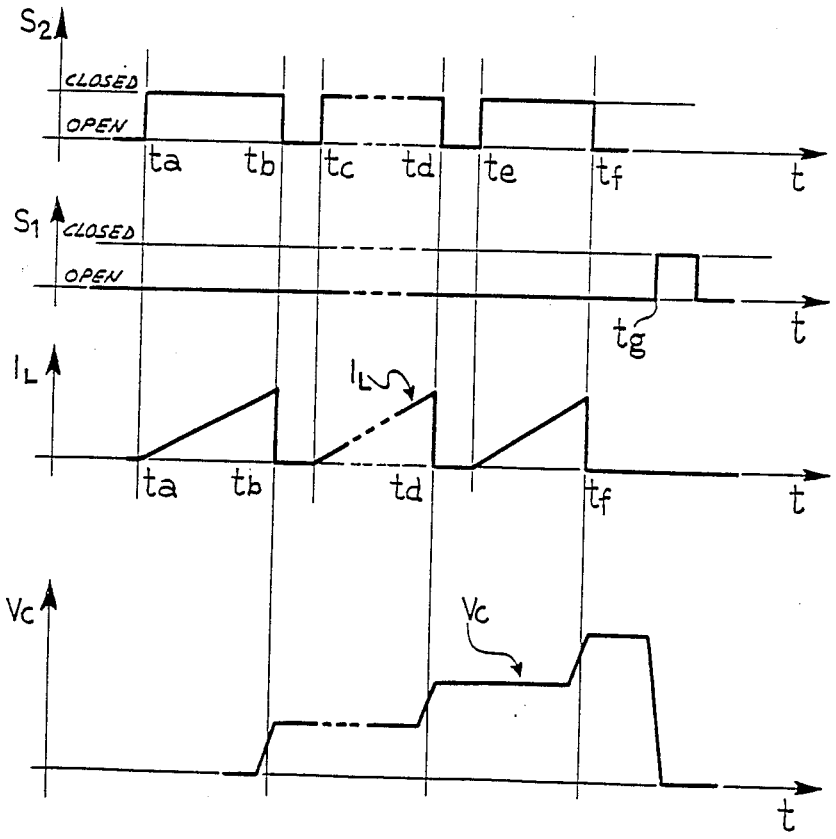

Further characteristics and advantages of the present invention will become clear from the detailed description which follows with reference to the appended drawings, provided by way of non-limiting example, in which:

FIG. 1 is a circuit diagram of an ignition system according to the invention, FIG. 2 is a series of graphs showing the changes in several signals generated in the ignition system of FIG. 1 in a first mode of operation, as functions of time shown on the abscissa, and FIG. 3 is a series of graphs showing the changes in several signals generated in the system of FIG. 1 in a second mode of operation, as functions of time shown on the abscissa.

With reference to FIG. 1, the ignition system according to the present invention includes a low-voltage direct-current supply 1 such as, for example the battery of a motor vehicle. One end of an inductor L is connected to the positive pole of the battery. The other end of L is connected to the anode of a diode 2 whose cathode is connected to the primary winding $L_1$ of an ignition coil IC whose secondary winding $L_2$ is connected to a spark plug SP.

An electronic switch $S_1$ arranged between the winding $L_1$ of IC and the negative pole of the supply 1 is constituted, for example, by a MOSFET transistor piloted by a control unit ECU.

The ECU also controls a second electronic switch $S_2$ arranged between the inductor L and the negative pole of the supply 1.

A capacitor, indicated C, is connected in parallel with the branch circuit including $L_1$ and $S_1$.

Sensors indicated $D_1$–$D_n$ provide the ECU with electrical signals indicative of operating conditions of the engine, for example, its rate of revolution, its temperature, the vacuum in the intake manifold, etc.

The ECU is also connected to the terminals of the capacitor C so as to be able to detect their potential difference.

The control unit ECU can be formed with the use of an integrated microprocessor and is arranged, by conventional programming techniques, to pilot the switches $S_1$ and $S_2$ (and thus the operation of the entire system) either in a first or in a second operative mode in dependence on signals provided by the sensors $D_1$–$D_n$ and/or the voltage across the capacitor C, as will be described more fully below with reference to FIGS. 2 and 3.

The first mode of operation of the system according to the invention will now be described with reference to the graphs of FIG. 2.

In order to produce a spark in the plug SP, the ECU closes $S_2$ at a time $t_0$ whilst $S_1$ remains open. In this condition, only the inductor L is connected to the supply 1 and a current IL which gradually increases in strength flows therein, as shown in FIG. 2.

At a subsequent time, indicated $t_1$, the ECU opens $S_2$ and closes $S_1$. In this condition, the inductor L is coupled to the capacitor C with which it forms a resonance circuit: the current $I_L$ in the inductor L decays in the manner shown whilst the voltage across the terminals C increases initially and then falls to zero again. A corresponding current $I_{L1}$ flows in the primary winding $L_1$ of the ignition coil IC and its changes are shown qualitatively in FIG. 2 as it triggers the spark in the plug SP.

In the second mode of operation mentioned above, in order to generate a spark, they system operates as follows.

The ECU first causes a plurality of cycles to be effected to charge the capacitor C by causing $S_2$ to close and open successively whilst $S_1$ remains open, as shown in FIG. 3 with reference to the times indicated $t_a$–$t_f$. Upon each opening of $S_2$, the current $I_L$ decays almost instantaneously whilst the voltage across the capacitor C is increased. This voltage therefore rises in steps and can be brought to a level much higher than that of the supply 1.

After the voltage across C has reached a predetermined level, the ECU closes $S_1$ at a time indicated $t_g$ in FIG. 3: the capacitor C is thus discharged into the primary winding $L_1$ of the ignition coil triggering the spark in the plug SP.

In general, the number and duration of the charging cycles for the capacitor C may be varied suitably in dependence on the value, detected by the ECU, of the voltage to which the capacitor C is gradually brought and in dependence on the final desired value of the voltage and the acceleration of the engine.

Conveniently, the ECU is arranged to pilot $S_1$ and $S_2$ so as to operate in the first mode described above as long as the rate of rotation of the engine is below a predetermined value or as long as the unit detects that the voltage reached in the capacitor C as a result of its connection to the inductor L, reaches a satisfactory value at least.

When the rate of revolution of the engine exceeds a predetermined value or as soon as the value of the voltage across the terminals of C is insufficient to trigger a good spark, the ECU renders the second mode described above operative.

The ECU returns to the first mode of operation when the rate of rotation of the engine falls below a predetermined value again or when it detects that the voltage across the terminals of C is reaching a predetermined value (in dependence on the desired operating conditions of the engine) within a predetermined minimum number of charging cycles (for example two cycles).

By virtue of the fact that the most favourable of the two possible operating modes described above can be selected, the system according to the invention ensures that high-energy sparks are generated without the need for high-inductance ignition coils and also with the use of alternators of limited power.

Although reference has been made in the above description to a system including a single plug, the invention is obviously suitable for use in general in ignition systems including a plurality of plugs, with or without a distributor.

What is claimed is:

1. An ignition system for an internal combustion engine, including a direct-current, low-voltage supply, at least one spark plug, an ignition coil with a primary winding for connection to the supply and a secondary winding for connection to the at least one plug, a first electronic switch between the primary winding of the coil and the supply for controlling the current flow in the primary winding, sensor means for providing electrical signals indicative of operating conditions of the internal combustion engine, and an electronic control and operating unit arranged to control the said first electronic switch in a predetermined manner in dependence on the signals provided by the sensor means, wherein said system also includes an inductor between said supply and said primary winding of the ignition coil, a capacitor in parallel with said primary winding and said first electronic switch, a second electronic switch between said inductor and said supply, which is adapted, in the closed condition, to disconnect the supply from the circuit downstream of the inductor; and wherein, in order to produce a spark in said at least one plug, said control and operating unit is adapted to pilot said first and said second switches in a mode selected from a first operative mode and a second operative mode in dependence on the signals provided by said sensor means;

in said first operative mode, said control and operating unit effecting the closure of said second switch and the connection of said inductor to said supply in order to store energy in said inductor, and then the opening of said second switch and the closure of said first switch in order to connect said inductor to said capacitor so as to form a resonance circuit whose energy is discharged into said primary winding of said coil;

and, in said second operative mode said unit effecting a plurality of cycles for charging said capacitor, in each of which said second switch is closed in order to store energy in said inductor and then opened in order to transfer the energy to said capacitor so that, in each cycle, the voltage across said capacitor is raised until it reaches a predetermined value, and then the closure of said first switch and the discharge of said capacitor into said primary winding of the ignition coil.

2. A system as claimed in claim 1, wherein said sensor means include a sensor for sensing the rate of rotation of said engine and wherein said control and operating unit is adapted to change from said first operative mode to said second operative mode when said sensor indicates that the rate of rotation of said engine exceeds a predetermined threshold value.

3. A system as claimed in claim 1, wherein said system also includes monitoring means for providing said control and operating unit with signals indicative of the voltage across said capacitor and wherein said control and operating unit is adapted to change from said first operative mode to said second operative mode, regardless of the signals provided by said sensor means, when the voltage across said capacitor does not reach a predetermined minimum value in said first operative mode.

4. A system according to claim 1, wherein said system also includes monitoring means for providing said control and operating unit with signals indicative of the voltage across said capacitor, and wherein said control and operating unit is adapted to change from said second operative mode to said first operative mode regardless of the signals provided by said sensor means when the voltage across said capacitor reaches a predetermined value within a predetermined minimum number of charging cycles in said second operative mode.

* * * * *